United States Patent [19]

Miller

[11] Patent Number: 4,584,262

[45] Date of Patent: Apr. 22, 1986

[54] PROCESS OF MAKING POST-STRETCH POLYESTER TERPOLYMER RESIN SUBS FOR POLYESTER SUPPORTS FOR PHOTOGRAPHIC ELEMENTS

[75] Inventor: Conrad E. Miller, Hendersonville, N.C.

[73] Assignee: E. I. Du Pont de Nemours and Company, Wilmington, Del.

[21] Appl. No.: 672,352

[22] Filed: Nov. 16, 1984

Related U.S. Application Data

[63] Continuation-in-part of Ser. No. 639,540, Aug. 10, 1984, abandoned, which is a continuation of Ser. No. 382,572, May 27, 1982, abandoned.

[51] Int. Cl.[4] ..... G03C 1/76

[52] U.S. Cl. ..... 430/533; 427/299; 427/316; 427/393.5

[58] Field of Search ..... 430/533; 427/299, 316, 427/393.5

[56] References Cited

U.S. PATENT DOCUMENTS

| | | | |
|---|---|---|---|
| 2,698,241 | 12/1954 | Saner | 430/533 |
| 4,187,105 | 2/1980 | Wainer et al. | 430/533 |
| 4,304,851 | 12/1981 | McGrail et al. | 430/533 |
| 4,307,174 | 12/1981 | Noonan et al. | 430/533 |

*Primary Examiner*—Jack P. Brammer

[57] ABSTRACT

Oriented and heat-set polyester film base is coated from nonflammable organic solvents with a polyester terpolymer resin to improve the anchorage of subsequently applied layers (e.g., photographic emulsions).

6 Claims, No Drawings

PROCESS OF MAKING POST-STRETCH POLYESTER TERPOLYMER RESIN SUBS FOR POLYESTER SUPPORTS FOR PHOTOGRAPHIC ELEMENTS

CROSS REFERENCE TO RELATED APPLICATION

This is a continuation-in-part of Ser. No. 639,540, filed Aug. 10, 1984, now abandoned which in turn is a continuation of Ser. No. 382,572 filed May 27, 1982, now abandoned.

This invention relates to photographic film elements, and particularly to transparent photographic film elements having an improved anchoring substratum (commonly known as a subbing or "sub" layer) between the film base and the water-permeable colloid layer or layers disposed thereon.

BACKGROUND OF THE INVENTION

It is common practice in the manufacture of photographic films to employ as a film support a dimensionally stable biaxially oriented heat-set polyester such as polyethylene terephthalate. Polyethylene terephthalate films are conventionally prepared, for example, by catalytic ester-interchange reaction between dimethylterephthalate and ethylene glycol, followed by catalytic polymerization under vacuum of the resulting dihydroxy ethylene terephthalate monomer. The final polymer is then cast as a film, biaxially oriented by stretching, and heat-set. Films made in this manner have a relatively hydrophobic surface, and do not adhere well to hydrophilic coatings containing gelatin. Accordingly, it is customary to employ several intermediate layers between the support and the photographic emulsion layer in order to effect suitable adhesion between the two. Generally, two intermediate layers are used. The first is a chlorine-containing copolymer resin coating applied to the polyester support after the latter has been cast into film but before it has been stretched to obtain the desired biaxial orientation and heat-set. This resin coating provides good adhesion to the polyester, and at the same time provides good adhesion to the second subbing layer, which is applied after stretching and heat-setting. This second layer is usually composed of a hydrophilic colloid such as gelatin, which in turn adheres well to the gelatin-containing photographic emulsion layer. Before applying the photographic emulsion layer, the dual-subbed polyester support is heat-relaxed to achieve dimensional stability.

The trouble with the system described is that a certain amount of scrap film is formed in the process of biaxial orientation and heat-setting of the polyester film, and it cannot be recycled because the first subbing layer has already been applied, and it is incompatible with the composition of the recycle. This prevents recycle of the polyester film unless the first subbing layer is removed beforehand, and its removal is costly and difficult, making this undesirable. As a result much film has to be discarded instead of being recycled. The present invention provides a solution of this problem.

SUMMARY OF THE INVENTION

In its simplest form the invention is directed to an article of manufacture comprising a biaxially oriented polyester film base coated post-stretch with a subbing layer composed of (a) a polyester terpolymer resin prepared by the polymerization of an ester of at least 2 dicarboxylic acids with at least one diol, and (b) a diisocyanate curing (cross-linking) agent, which serves to improve adhesion further. In a further modification the resulting film base is coated with (1) a gelatin-containing second subbing layer contiguous thereto, and (2) a photosensitive gelatino-silver halide emulsion on said second subbing layer. Since subbing layer (a) (b) is applied after the orientation and heat-setting steps, scrap generated at these steps can be recycled since it is uncoated with resin.

DETAILED DESCRIPTION OF THE INVENTION

The polyester terpolymer resin subbing composition of this invention is prepared by direct esterification of at least two dicarboxylic acids with at least one diol, followed by polymerization. When a dispersion of this resin composition, mixed with a diisocyanate crosslinking agent in an organic solvent, is coated on a polyester film support after the latter has been biaxially oriented and heat-set, this first subbing layer will firmly bond to the polyester support and will also supply excellent wet and dry anchorage and adhesion to the gelatin-containing second subbing layer applied later from aqueous solutions. This makes it possible to recycle any scrap polyester film that was formed during the stretching step, since the polyester terpolymer resin subbing layer of this invention will not have been applied at that stage. After heat relaxing, the subbed element of this invention is eminently suitable for the coating of subsequent layers of photographic silver halide emulsions, for example.

The polyester terpolymer resins useful in preparing the resin subbing of this invention are made by direct esterification and polymerization of at least two dicarboxylic acids and at least one diol. Dicarboxylic acid useful in preparing the resins of this invention include, for example, terephthalic acid, isophthalic acid, azelaic acid, adipic acid, and mixtures thereof. Diols include, for example, ethylene glycol, and 1.4-butanediol (butylene gylcol) among others. Monomer ratios are varied to obtain such desired properties as solubility, softening point, hardness, flexibility, adhesion, etc. A diisocyanate crosslinking agent (e.g. toluene diisocyanate) is included to enhance the physical, chemical, and thermal properties of the resin mixture. Other diisocyanates include: m-phenylene diisocyanate, p-phenylene diisocyanate, 1-chloro-2,4-phenylene diisocyanate, 3,3'-dimethyl-4,4'-biphenylene diisocyanate, 3,3'-dimethoxy-4,4'-biphenylene diisocyanate, 2,2', 5,5'-tetramethyl-4,4'-biphenylene diisocyanate, 1,5-naphthalene diisocyanate, 4,4'-diphenylmethylene diisocyanate, 3,3'-dimethyl-4,4'-diphenylmethylene diisocyanate, 4,4'-diphenylisopropylidene diisocyanate, Polymethylene diisocyanates, and polyoxyalkyl diisocyanates. Isocyanate-terminated prepolymers formed by reacting the above-mentioned diisocyanates with diols, hydroxy-terminated polyethers, and hydroxyl-terminated polyesters may also be useful.

Some particularly preferred resin compositions are:

A. 2G:T/I/9/6- ethylene glycol (100 mole %): terephthalic acid (40 mole %)/isophthalic acid (40 mole %)/azelaic acid (10 mole %)/adipic acid (10 mole %).

B. 2G:T/I/9 - ethylene glycol (100 mole %): terephthalic acid (33 mole %)/isophthalic acid (17 mole %)/azelaic acid (50 mole %).

C. 2G:T/9 -ethylene glycol (100 mole %): terephthalic acid (53 mole %)/azelaic acid (47 mole %)

D. 2G/4G:T/I/9 -ethylene glycol (90 mole %)/-butylene glycol (10 mole %):terephthalic acid (50 mole %)/isophthalic acid (20 mole %)/azelaic acid (30 mole %).

E. 2G/4G:T/9 -ethylene glycol (75 mole %)/butylene glycol (25 mole %):terephthalic acid (55 mole %)/azelaic acid (45 mole %).

The desired polyester terpolymer resin is essentially water-insoluble and hence must be dissolved in a suitable organic solvent. It is preferred to employ methylene chloride or 1,1,2-trichloroethane solutions containing 1-10% by weight of the polyester terpolymer resin and 3-10% by weight (based on the resin) of toluene diisocyanate. This solution is then coated on a polyester film after the film has been made dimensionally stable by biaxially orienting and heat-setting. The adhesion of this solution to the polyester film is more than adequate. It may be further improved by energy-treating the film beforehand with a corona discharge or an electric spark, for example, but such treatments are not necessary and, in point of fact, not particularly preferred since they add considerably to the cost of manufacture. Other useful solvents include acetone, benzyl alcohol, butyrolactone, chloroform, cyclohexanone, dimethyl sulfoxide, dioxane, ethyl acetate, ethyl alcohol, methylethyl ketone, methyl isobutyl ketone, tetrahydrofuran, toluene, and trichloroethylene among others. The resin compositions described above have some solubility in these solvents, which are compatible with commercial coating operations. Naturally, a number of these solvents are highly flammable and thus would not be commercially viable for use in the process of this invention. However, if the proper safety procedures were applied and carefully used, any of the above mentioned solvents could be used within the ambit of this invention.

In a preferred embodiment wherein the solvent is methylene chloride the advantages of this invention are as follows:

(a) improved polyester scrap recovery (b) elimination of prestretch subbing and related problems (c) nonflammable solvent (d) resins commercially available (e) relatively low drying load (f) solvent has low toxicity and is widely used in industry.

(g) gelatin-containing second subbing layers can be applied directly from aqueous solutions without the aid of surface treatments, etching, or swelling agents.

Polyester films useful in the practice of this invention are formed from the polyesterification product of dimethyl terephthalate and ethylene glycol and further made according to the teachings of Alles, U.S. Pat. No. 2,779,684 "Polyester Films and Their Preparation" (1957) and Whinfield et al, U.S. Pat. No. 2,465,319 "Polymeric Linear Terephthalatic Esters" (1949) and the patents referred to in the specifications thereof. Other suitable films are the polyethylene terephthalate/isophthalates of British Pat. No. 766,290 and Canadian Pat. No. 566,672 and those obtained by condensing terephthalic acid and dimethyl terephthalate with propylene glycol, diethylene glycol, tetramethylene glycol or cyclohexane 1,4-dimethanol (hexahydro-p-xylene alcohol). The photographic film bases of Bauer et al, U.S. Pat. No. 3,052,543 "Photographic Film Base and Film" (1962) may also be used. Films prepared from these polyesters are particularly suitable because of their dimensional stability and excellent optical clarity.

Films containing the polyester terpolymer resin subbing layers of this invention demonstrate excellent anchorage to the film itself and permit the coating of subsequent gelatin layers from aqueous solutions with improved anchorage. These final elements, with resin and gelatin subs, are eminently suitable for coating other layers such as gelatino-silver halide emulsion layers of varying types (negative, positive, X-rays, etc.).

The silver halide emulsions prepared in accordance with this invention can comprise for example, silver chloride, silver bromide, silver bromoiodide, silver chlorobromide, silver chloroiodide, silver chlorobromoiodide crystals or mixtures thereof. The emulsions may be coarse or fine grain emulsions and prepared by any of the well-known techniques.

The photographic emulsions produced in accordance with the practice of this invention may contain the normal addenda useful in photographic silver halides. Typical addenda which may be added are chemical sensitizers, development modifiers, antifoggants and stabilizers, developing agents, hardeners, spectral sensitizers and the like.

The invention is illustrated by the following examples, wherein Resin Compositions A, B, C, and D are those previously identified by the same numbers.

EXAMPLE 1

The following solutions were prepared:

| | | | % Solids | % Crosslinker[1] |
|---|---|---|---|---|
| 1. | 83 g | Methylethyl ketone | 5.1 | 0 |
| | 17 g | 30% solution of Resin Composition B in methylethyl ketone | | |
| 2. | 66 g | Toluene | 5.1 | 0 |
| | 34 g | 15% solution of Resin Composition C in 1,1,2-trichloroethane | | |
| 3. | 100 g | Methylene chloride | 4.0 | |
| | 25 g | 20% solution of Resin Composition A in a mixture of dioxane/toluene/cyclohexane | | |
| | 0.25 g | RC-803 Curing agent[2] | | 3.8 |
| 4. | 100 g | Methylene chloride | 4.4 | |
| | 17 g | 30% Solution of Resin Composition B in methylethyl ketone | | |
| | 0.5 g | RC-803 Curing agent | | 7.4 |
| 5. | 100 g | Methylene chloride | 3.8 | |
| | 34 g | 15% Solution of Resin Composition C in 1,1,2-trichloroethane | | |
| | 0.44 | RC-803 Curing agent | | 6.5 |

[1]Based on solids

[2]This is a diisocyanate prepolymer sold by E. I. du Pont de Nemours and Company and made from toluene diisocyanate and trimethylol propane. Wherever it is referred to in Examples 1, 2 and 3 it is used as a 75% solution in ethyl acetate.

These solutions were coated individually on biaxially oriented polyethylene terephthalate film supports of 4 mil (0.0102 cm) thickness to a wet layer thickness of about 2 mil (0.0051 cm) using a conventional doctor knife. The following "gel sub" (gelatin subbing layer) was then prepared:

| Gel Sub Composition: | |
|---|---|
| Ingredient | Amount (g) |
| Distilled Water | 2650.0 |
| 10% gelatin in $H_2O$ | 202.0 |
| 5% Cetyl Betaine (Product BCO,[1] wetting agent) in $H_2O$ | 26.9 |
| 1% Neomyacine sulfate in $H_2O$ | 7.6 |
| 10% Chrome Alum in $H_2O$ | 3.6 |
| Ethyl alcohol | 112.0 |
| Teflon 30C[1] | 0.5 |
| pH | 6.28 |

[1]Registered trademarks of E. I. du Pont de Nemours and Company, Wilmington, DE.

Coatings 1, 2, 3, 4 and 5 were each overcoated with the above described gel sub composition to a wet thickness of about 2 mil (0.0051 cm) and the coatings dried. Each film sample was then heat relaxed in a 135° C. oven for 3 minutes and a conventional, negative-working, coarse grained gelatino-silver iodobromide X-ray type emulsion was then applied over the gel sub. The emulsion-/overcoated film was then dried at room temperature for 4 hours and the sample was exposed and developed and given anchorage tests as follows:

Dry Anchorage:

1. Scribe 24 ¼" (0.64 cm)×¼" (0.64 cm) square through the emulsion using a suitable template and stylus.
2. Remove any particulates that result.
3. Place a piece of ¾" (1.9 cm) No. 600 Scotch Tape (3M Co., Minneapolis, MN) over the scribed pattern.
4. Rub tape firmly with finger pressure to obtain good contact.
5. Grasp end of tape and quickly rip from the surface at a 30° C. angle.
6. Count number of squares of emulsion removed by this process.

Wet Anchorage:

1. Soak film in water for 5 minutes.
2. Place wet film on a smooth, hard surface.
3. Draw a line on the sample through emulsion with a stylus.
4. Rub over scribed area ten times with a moistened rubber eraser having a 500 g weight attached thereto.
5. Measure amount of emulsion peel-back. The following results were achieved:

| Sample | % Dry Anchorage Failure | Wet Anchorage |
|---|---|---|
| 1 | 100 | poor |
| 2 | 100 | poor |
| 3 | 0 | excellent |
| 4 | 0 | excellent |
| 5 | 0 | excellent |

This example demonstrates that it is necessary to use the novel resin compositions of this invention and a crosslinker in order to achieve satisfactory anchorage.

EXAMPLE 2

The following solutions were prepared:

| | | | % Solids | % Crosslinker[1] |
|---|---|---|---|---|
| 1. | 100 g<br>25 g | Methylethyl ketone<br>20% solution of Resin Composition A in a mixture of dioxane/toluene/-cyclohexane | 4.0 | 0 |
| 2. | 100 g<br>17 g | Methylene chloride<br>30% solution of Resin Composition B in methylethyl ketone | 4.4 | 0 |
| 3. | 100 g<br>34 g | Methylene chloride<br>15% solution of Resin Composition C in 1,1,2-tri-chloroethane | 3.8 | 0 |
| 4. | 100 g<br>25 g | Methylene chloride<br>20% solution of Resin Composition A in a mixture of dioxane/toluene/-cyclohexane | 4.0 | |
| | 0.25 g | RC-803 Curing agent | | 3.8 |
| 5. | 100 g<br>17 g | Methylene chloride<br>30% solution of Resin Composition B in methylethyl ketone | 4.4 | |
| | 0.5 g | RC-803 Curing agent | | 7.4 |
| 6. | 100 g<br>34 g | Methylene chloride<br>15% solution of Resin Composition C in 1,1,2-trichloro-ethane | 3.8 | |
| | 0.44 g | RC-803 Curing agent | | 6.5 |

[1]Based on solids

These samples were coated on polyethylene terephthalate film, overcoated with a gel sub, heat relaxed, and coated with a silver halide emulsion as described in Example 1. Anchorage was tested as described in Example 1 with the following results:

| Sample | % Dry Anchorage Failure | Wet Anchorage |
|---|---|---|
| 1 | 60 | poor |
| 2 | 0 | poor |
| 3 | 30 | poor |
| 4 | 0 | good |
| 5 | 0 | good |
| 6 | 0 | good |

EXAMPLE 3

The following solution was prepared:

| | | Wt. % Solids |
|---|---|---|
| Methylene chloride | 2340 g | |
| Resin Composition D | 60 g | 2.5 |
| RC-803 Curing agent | 2.8 g | |

This material was coated on an 11 inch wide (27.94 cm) biaxially oriented polyethylene terephthalate film support (7 mil, 0.0178 cm, thick) using an extrusion coater at 12 fpm. A total of 1100 ft (335.28 meters) were coated to a thickness of 0.24 g/m$^2$ of the resin sub. Samples from this coating are overcoated with a gel sub and a silver halide emulsion as previously described. Anchorage, both wet and dry, was considered to be excellent as compared to controls containing film coated with conventional resin subs.

EXAMPLE 4

A solution of Resin Composition E in methylene chloride (2.5% solids) was split into three portions. Varying levels of toluene diisocyanate were added to each portion in the amount of 3%, 6%, and 9% by weight, respectively, based on the resin composition. These portions were then extrusion coated individually on biaxially oriented film as described in Example 3 and samples from these coatings were coated with gel and silver halide emulsion as described therein. Two experiments were run to achieve coating weights of 0.36 and 0.20 g/m$^2$ of the resin sub. Anchorage tests (wet and dry) were run (1) on all samples fresh, (2) after 1 week aging in an oven at 49° C. and 60% RH, (3) after 3 months room aging, and (4) after 6 months room aging. In all cases the anchorage of this composition was excellent.

I claim:

1. A process for preparing a photographic element comprising, in order, the steps of:

(1) biaxially orienting a polyester film by stretching and heat-setting;

(2) coating from an organic solvent a first subbing layer consisting essentially of a mixture of:

(a) a polyester resin prepared by the direct esterification of at least two different dicarboxylic acids and at least one diol; and, (b) a diisocyanate curing agent in an amount of 3 to 10% by weight based on the weight of component (a);

(3) coating contiguous to the first subbing layer a second subbing layer consisting essentially of aqueous gelatin;

(4) heat-relaxing the coated polyester film; and (5) coating a photosensitive, gelatino-silver halide emulsion layer contiguous to the second subbing layer.

2. The process of claim 1 wherein the polyester resin is prepared from terephthalic acid (53 mole %), azelaic acid (47 mole %), and ethylene glycol (100 mol %).

3. The process of claim 1 wherein the polyester resin is prepared from ethylene glycol (100 mole %):terephthalic acid (40 mole %)/isophthalic acid (40 mole %)/azelaic acid (10 mole %)/adipic acid (10 mole %).

4. The process of claim 1 wherein the polyester resin is prepared from ethylene glycol (90 mole %)/butylene glycol (10 mole %):terephthalic acid (50 mole %)/isophthalic acid (20 mole %)/azelaic acid (30 mole %).

5. The process of claim 1 wherein the polyester resin is prepared from ethylene glycol (75 mole %)/butylene glycol (25 mole %):terephthalic acid (55 mole %)/azelaic acid (45 mole 5).

6. The process of claim 1 wherein the polyester resin is prepared from ethylene glycol (100 mole %):terephthalic acid (33 mole %)/isophthalic acid (17 mole %)/adipic acid (50 mole %).

* * * * *